United States Patent [19]

Gutierrez et al.

[11] Patent Number: 4,839,073

[45] **Date of Patent: * Jun. 13, 1989**

[54] POLYOLEFINIC SUCCINIMIDE POLYAMINE ALKYL ACETOACETATE AND SUBSTITUTED ACETATE ADDUCTS AS COMPATIBILIZER ADDITIVES IN LUBRICATING OIL COMPOSITIONS

[75] Inventors: Antonio Gutierrez, Mercerville, N.J.; Jacob Emert, Brooklyn, N.Y.; Robert A. Kleist, Bayonne; Malcolm Waddoups, Westfield, both of N.J.

[73] Assignee: Exxon Chemical Patents Inc., Linden, N.J.

[ * ] Notice: The portion of the term of this patent subsequent to Jun. 13, 2006 has been disclaimed.

[21] Appl. No.: 51,275

[22] Filed: May 18, 1987

[51] Int. Cl.[4] ..... C10M 133/16

[52] U.S. Cl. ..... 252/51.5 A; 252/32.7 E; 252/35; 252/39; 252/52 A; 252/51.5 R; 252/56 R; 252/565; 252/56 D; 548/546; 548/547

[58] Field of Search ..... 252/51.5 A, 32.7 E, 252/39, 51.5 R

[56] References Cited

U.S. PATENT DOCUMENTS

| | | | |
|---|---|---|---|
| 3,215,707 | 11/1965 | Rense et al. | 260/326.3 |
| 3,280,034 | 10/1966 | Anzenberger et al. | 252/51.5 |
| 3,390,086 | 6/1968 | O'Halloran | 252/47.5 |
| 3,455,831 | 7/1969 | Davis | 252/51.5 |
| 3,455,832 | 7/1969 | Davis | 252/51.5 |
| 3,888,773 | 6/1975 | Nnadi et al. | 252/51.5 A |
| 3,927,041 | 12/1975 | Cengel et al. | 260/346.8 |
| 4,062,786 | 12/1977 | Brois et al. | 252/51.5 |
| 4,113,639 | 9/1978 | Lonstrup et al. | 252/51.5 |
| 4,116,876 | 9/1978 | Brois et al. | 252/49.6 |
| 4,123,373 | 10/1978 | Brois et al. | 252/48.6 |
| 4,234,435 | 11/1980 | Meinhardt et al. | 252/51.5 |
| 4,375,974 | 3/1983 | Maldonado et al. | 252/51.5 A |
| 4,447,348 | 5/1984 | Forsberg | 252/51.5 A |
| 4,521,318 | 6/1985 | Karol | 252/51.5 A |
| 4,548,724 | 10/1985 | Karol et al. | 252/51.5 |
| 4,579,675 | 4/1986 | Sawicki et al. | 252/51.5 |
| 4,612,132 | 9/1986 | Wollenberg et al. | 252/51.5 A |
| 4,614,603 | 9/1986 | Wollenberg | 252/51.5 A |

OTHER PUBLICATIONS

Smalheer et al., "Lubricant Additives", 1967.

G. O. Torosyan et al., *Institute of Organic Chemistry, Academy of Sciences of the Armenian SSR*, translated from Zhurnal Organischeskoi Khimii, vol. 18, "Amines and Ammonium Compounds. CLX, Amides of Acetoacetic Acid", pp. 1229–1231.

*Primary Examiner*—William R. Dixon, Jr.
*Assistant Examiner*—Ellen McAvoy
*Attorney, Agent, or Firm*—E. T. Wheelock; J. B. Murray, Jr.

[57] ABSTRACT

This invention is to compatibility aids containing polyolefinic succinimide polyamide alkyl acetoacetate or trialkyl acetic anhydride adducts of the general formula:

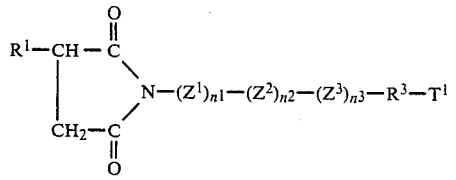

wherein $Z^1$ and $Z^3$ are the same or different and are moities of the formula:

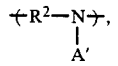

$Z^2$ is a moiety of the formula:

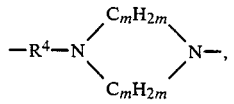

wherein $R^2$, $R^3$ and $R^4$ are the same or different and are alkylene of from 1 to 6 carbon atoms, m is an integer of from 1 to 5, each A' is independently selected from the group consisting of H, A and the moiety:

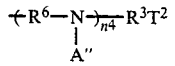

wherein A'' is H or A, $R^3$ is as defined above, $R^6$ is alkylene of from 1 to 6 carbon atoms, $T^1$ and $T^2$ are the same or different and each comprises a member selected from the group consisting of moieties of the formula:

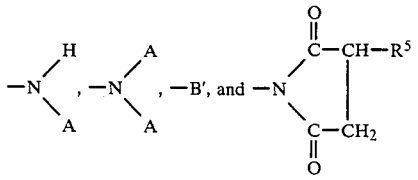

wherein B' is substituted or unsubstituted alkyl or aryl-containing group, $n^1$ is an integer of 0 to 10, $n^2$ is an integer of 0 to 10, $n^3$ is an integer of from 0 to 10, $n^4$ is an integer of from 0 to 10, with the proviso that the sum of $n^1$, $n^2$, $n^3$ and $n^4$ is from 3 to 10 and the sum of $n^1$, $n^3$ and $n^4$ is at least 1, wherein $R^1$ and $R^5$ are independently an olefin polymer having a number average molecular weight ($\overline{M}_n$) between about 650 and 3,500, and wherein (Abstract continued on next page.)

A comprises: (i) substituted acetyl moiety of the formula:

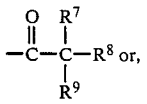

(ii) a tautomeric substituent of the formula:

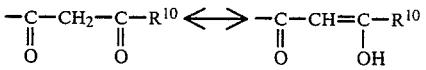

wherein $R^7$, $R^8$ and $R^9$ are the same or different and are H or alkyl of from 1 to 4 carbon atoms, and wherein $R^{10}$ is substituted or unsubstituted alkyl or aryl containing groups, with the proviso that at least one of the A′ or A″ groups comprises the substituted acetyl or the tautomeric substituent.

61 Claims, No Drawings

POLYOLEFINIC SUCCINIMIDE POLYAMINE ALKYL ACETOACETATE AND SUBSTITUTED ACETATE ADDUCTS AS COMPATIBILIZER ADDITIVES IN LUBRICATING OIL COMPOSITIONS

CROSS-REFERENCE TO RELATED APPLICATIONS

This application is related to the following applications, all filed on even date herewith: Ser. No. 51,276, filed May 18, 1987, "Polyolefinic Succinimide Polyamine Alkyl Acetoacetate Adducts"; Ser. No. 51,146, filed May 18, 1987, "Polyolefinic Succinimide Polyamine Alkyl Acetoacetate Adduct Dispersants"; Ser. No. 51,273 filed May 18, 1987, "Polyolefinic Succinimide Polyamine Alkyl Acetoacetate Adducts as Dispersants in Lubricating Oil Compositions".

FIELD OF THE INVENTION

This invention is to lubricating oils and concentrates containing the product of polyolefinic succinimide polyamine reacted with alkyl acetoacetate or substituted acetic anhydrides to form adducts of the general formula:

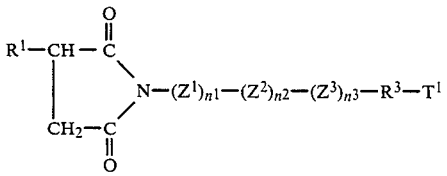

wherein $Z^1$ and $Z^3$ are the same or different and are moieties of the formula:

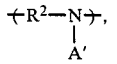

$Z^2$ is a moiety of the formula:

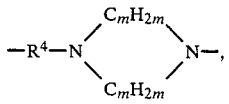

wherein $R^2$, $R^3$ and $R^4$ are the same or different and are alkylene groups of from 1 to 6 carbon atoms, m is an integer of from 1 to 5, each A′ is independently selected from the group consisting of H, A and the moiety:

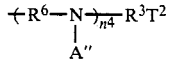

wherein A″ is H or A, $R^3$ is as defined above, $R^6$ is alkylene of from 1 to 6 carbon atoms, $T^1$ and $T^2$ are the same or different and each comprises a member selected from the group consisting of moieties of the formula:

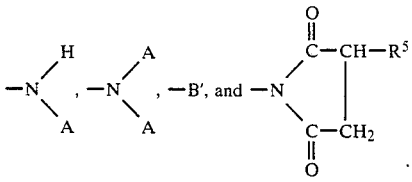

wherein B′ is substituted or unsubstituted alkyl or aryl-containing group, $n^1$ is an integer of 0 to 10, $n^2$ is an integer of 0 to 10, $n^3$ is an integer of from 0 to 10, $n^4$ is an integer of from 0 to 10, with the provisos that the sum of $n^1$, $n^2$, $n^3$ and $n^4$ is from 3 to 10 and the sum of $n^1$, $n^3$ and $n^4$ is at least 1, wherein $R^1$ and $R^5$ are independently an olefin polymer having a number average molecular weight ($\overline{M}_n$) between about 650 and 3,500, and wherein A comprises:

(i) a substituted acetyl moiety of the formula:

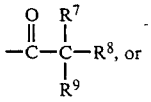

(ii) a tautomeric substituent of the formula:

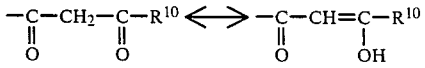

wherein $R^7$, $R^8$ and $R^9$ are the same or different and are H or alkyl of from 1 to 4 carbon atoms, and wherein $R^{10}$ is substituted or unsubstituted alkyl or aryl containing groups, with the proviso that at least one of the A′ or A″ groups comprises said substituted acetyl or said tautomeric substituent.

These adducts are especially useful in making stable concentrates of lubricating oil, or fuel oil compositions which contain high molecular weight dispersants, high total base number detergents, and various antiwear and/or antioxidant materials. These materials may be, in some circumstances, highly incompatible with each other. This incompatibility may result in phase separations when high molecular weight dispersants of the prior art are used instead of the adducts of this invention.

BACKGROUND OF THE INVENTION

Polyalkene substituted carboxylic acids are widely known and used as additives in the preparation of lubricating oils.

Illustrations of such materials are shown in numerous patents.

U.S. Pat. No. 3,215,707 discloses the reaction of chlorine with a mixture of polyolefins having molecular weights up to about 50,000 and maleic anhydride.

U.S. Pat. No. 3,927,041 discloses the reaction of 300 to 3,000 molecular weight polybutene with a dicarboxylic acid or anhydride to form materials which can be used per se, or as esters, amides, imides, amidines, or the like in petroleum products.

U.S. Pat. No. 4,062,786 provides an example (No. 13) of polyisobutylene succinic anhydride having a molecular weight of about 1300, a saponification number of about 100, and about 1.25 succinic anhydride units per polyisobutylene unit.

U.S. Pat. No. 4,123,373 shows a similar material having a molecular weight of about 1400, a saponification number of 80, and about 1.07 succinic anhydride units per polyisobutylene unit.

U.S. Pat. No. 4,234,435 also shows polyalkene substituted dicarboxylic acids derived from polyalkenes having an average molecular weight at 1,300 to 5,000.

Polyalkenyl succinic anhydrides have also been reacted with polyamines to form materials suitable for use as dispersants in lubricating oils.

U.S. Pat. Nos. 4,113,639 and 4,116,876 provide an example of an alkenyl succinic anhydride with a saponification number of 103, about 1.3 succinic anhydride units per hydrocarbon molecule, and in which the molecular weight of the alkenyl unit is about 1,300. The material is then reacted with a polyamine and boric acid U.S. Pat. No. 4,113,639 or with an amino alcohol and boric acid U.S. Pat. No. 4,116,876.

U.S. Pat. No. 4,548,724 teaches of a lubricating oil additive of the reaction product of a polycarboxylic acid, e.g., 1,3,6-hexane tricarboxylic acid, with a polyisobutylene succinimide of a polyamine.

U.S. Pat. No. 4,579,675 relates to the reaction products of polyalkylene succinimides (derived from polyethylene-polyamines) and 1,3-dicarbonyl compounds. However, the reaction temperatures are such that the products are materials known as N-substituted enaminones. Therefore, polyisobutenyl succinimide, derived from polyisobutenyl succinic anhydride and diethylene triamine, was reacted with ethyl acetoacetate at 110° C. to form the corresponding N-substituted enaminone. The enaminone reaction products are said to have detergent/dispersant properties when included in a lubricating oil composition.

No known disclosure suggests either the products disclosed herein or the use of these products as additives in the preparation of lubricating oils and concentrates which are stable to phase separation.

SUMMARY OF THE INVENTION

This invention is to oleaginous compositions, such as lubricating oil compositions and concentrates containing the product of polyolefinic succinimide polyamines reacted with alkyl acetoacetate or substituted acetic anhydride to form adducts of the general formula:

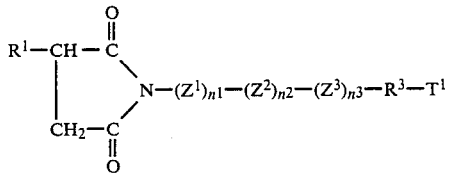

wherein $Z^1$ and $Z^3$ are the same or different and are moities of the formula:

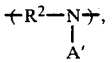

$Z^2$ is a moiety of the formula:

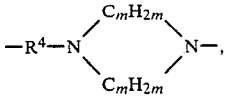

wherein $R^2$, $R^3$ and $R^4$ are the same or different and are alkylene of from 1 to 6 carbon atoms, m is an integer of from 1 to 5, each A' is independently selected from the group consisting of H, A and the moiety:

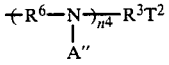

wherein A'' is H or A, $R^3$ is as defined above, $R^6$ is alkylene of from 1 to 6 carbon atoms, $T^1$ and $T^2$ are the same or different and each comprises a member selected from the group consisting of moieties of the formula:

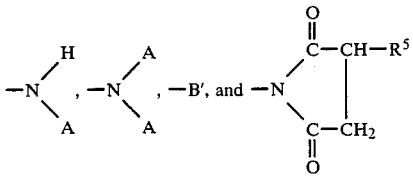

wherein B' is substituted or unsubstituted alkyl or aryl-containing group, $n^1$ is an integer of 0 to 10, $n^2$ is an integer of 0 to 10, $n^3$ is an integer of from 0 to 10, $n^4$ is an integer of from 0 to 10, with the provisos that the sum of $n^1$, $n^2$, $n^3$ and $n^4$ is from 3 to 10 and the sum of $n^1$, $n^3$ and $n^4$ is at least 1, wherein $R^1$ and $R^5$ are independently an olefin polymer having a number average molecular weight ($\overline{M}_n$) between about 650 and 3,500, and wherein A comprises:

(i) a substituted acetyl moiety of the formula:

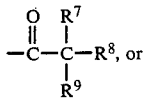

(ii) a tautomeric substituent of the formula:

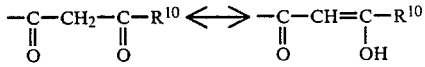

wherein $R^7$, $R^8$ and $R^9$ are the same or different and are H or alkyl of from 1 to 4 carbon atoms, and wherein $R^{10}$ is substituted or unsubstituted alkyl or aryl containing groups, with the proviso that at least one of the A' and A'' groups comprises said substituted acetyl or said tautomeric substituent.

Also included in the invention are mixtures of adducts fitting the above description; particularly adducts in which the mixtures contain adducts in which the $T^1$ and/or $T^2$ substituent is both the amide and the succinimide.

These adducts are useful in that they exhibit reduced interaction with and appear also to prevent interaction between the various components of additive packages used in producing motor oils and in the lubri-cating oils themselves. The resulting compositions are quite homogeneous and are stable to phase separation even at elevated temperatures.

The adducts are useful as compatability aids in compositions containing high molecular weight dispersants, high total base number detergents and antiwear agents or antioxidants. The adducts are also useful as replacements for high molecular weight dispersants in compositions also containing high total base number detergents, and antioxidant or antiwear additives.

DETAILED DESCRIPTION OF THE INVENTION

Lubricating oil compositions, e.g., automatic transmission fluids, heavy duty oils suitable for gasoline and diesel engines, etc., can be prepared using the compositions of this invention. Universal type crankcase oils, those in which the same lubricating oil composition is used for either gasoline or diesel engines, may also be prepared. These lubricating oil formulations conventionally contain several different types of additives that will supply the characteristics that are required for the particular use. Among these additives are included viscosity index improvers, antioxidants, corrosion inhibitors, detergents, dispersants, pour point depressants, antiwear agents, etc.

In the preparation of lubricating oil formulations, it is common practice to introduce the additives in the form of a concentrate (for instance, as an "ad pack") containing 10 to 80 weight percent, e.g., 20 to 70 weight percent, active ingredient in a solvent. The solvent may be a hydrocarbon oil, e.g., a mineral lubricating oil, or other suitable material. In forming finished lubricants, such as crankcase motor oils, these concentrates, in turn, may be diluted with 3 to 100 e.g., 5 to 40, parts by weight of lubricating oil per part by weight of the additive package. One uses concentrates, of course, to make the handling of the various constituent materials less difficult as well as to facilitate solution or dispersion of those materials in the final blend. Blending a lubricating oil composition containing several types of additives typically causes no problems if each additive is added separately. However, when an additive "package" having a number of additives in a single concentrate is to be used, the additives may interact with each other. For instance, high molecular weight dispersants have been found to interact with various other additives in the formulations, particularly, with overbased metal detergents to cause a viscosity increase upon blending. This initial increase may then be followed by a subsequent viscosity increase and may even result in gellation of the blend. Obviously, this hampers pumping, blending and handling of both the concentrate and the resulting product. Although the concentrate may be further diluted to reduce the interaction effect, the dilution increases the shipping, storage and handling costs. High molecular weight dispersants may interact with the other components, e.g., the antioxidant, antiwear agent, or friction modifier, in addition to the overbased metal detergent in such a way that the concentrate itself may separate into a number of phases during storage. The adducts discussed below substantially alleviate these interaction and separation or gellation problems. Indeed, these materials may be substituted for all or part of the other dispersant additives included in a concentrate or lubricating oil formulation.

THE COMPOSITIONS

Compositions made according to this invention generally will contain an oil of lubricating viscosity and:

a. high molecular weight ashless dispersants;
b. detergents having a high total base number;
c. compatibilizing effective amount of polyolefinic succinimide polyamine alkyl acetoacetate or other substituted acetate adducts of this invention; and
d. antiwear additives and/or antioxidants, particularly copper carboxylate anti-oxidants.

Depending upon the use to which the compositions are ultimately placed, the compositions may also include other antioxidants, friction modifiers, pour point depressants, viscosity index improvers and the like.

The compositions of this mixture may contain the above active agents (and which are discussed separately below) in amounts effective to provide their respective functions.

The adducts of this invention are oil-soluble, dissolvable in oil with the aid of a suitable solvent, or are stably dispersible materials. Oil-soluble, dissolvable, or stably dispersible as that terminology is used herein does not necessarily indicate that the materials are soluble, dissolvable, miscible, or capable of being suspended in oil in all proportions. It does mean, however, that the adducts, for instance, are soluble or stably dispersible in oil to an extent sufficient to exert their intended effect in the environment in which the oil is employed. Moreover, the additional incorporation of other additives may also permit incorporation of higher levels of an adduct, if desired.

The adduct compatibilizers of this invention will be generally used in an amount of from about 5 to 75 wt. %, preferably from about 10 to 65 wt. %, and more preferably from about 20 to 60 wt. %, of the additive package or concentrate containing the lubricating oil, the high molecular weight ashless dispersant and detergent. Typically, such concentrates or ad packs, stabilized by the method of the present invention, will comprise:

| | Broadly (wt. % A.I.) | Preferably (wt. % A.I.) |
|---|---|---|
| Adduct compatibilizers | 5 to 75 | 20 to 60 |
| Ashless dispersant (e.g., PIBSA-PAM) | 1 to 70 | 10 to 50 |
| Detergent (e.g., overbased Mg or Ca sulfonates and phenates) | 2 to 40 | 5 to 30 |
| Antiwear Additives (e.g., ZDDP) | 2 to 40 | 5 to 30 |
| Antioxidant (e.g., Cu carboxylate) | 0.5 to 25 | 1 to 15 |

When the compositions of the invention are used in the form of lubricating oil compositions, such as automotive crankcase lubricating oil compositions, a major amount of a lubricating oil may be included in the composition. Broadly, the composition may contain about 85 to about 99.99 weight percent of a lubricating oil. Preferably, about 93 to about 99.8 weight percent of the lubricating oil. The term "lubricating oil" is intended to include not only hydrocarbon oils derived from petroleum but also synthetic oils such as alkyl esters of dicarboxylic acids, polyglycols and alcohols, polyalphaolefins, alkyl benzenes, organic esters of phosphoric acids, polysilicone oils, etc., (as discussed more completely below).

When the compositions of this invention are provided in the form of concentrates, with or without the other noted additives, an amount, e.g., up to about 60 percent by weight, of a solvent, mineral or synthetic oil may be included to enhance the handling properties of the concentrate.

When the compositions are used in normally liquid petroleum fuels such as gasoline, and middle distillates boiling from about 66° to 430° C., including kerosene, diesel fuels, home heating fuel oil, jet fuels, etc., a concentration of the adduct additive of this invention in the fuel in the range of 0.001 to 0.5, preferably about 0.001 to 0.1 weight percent, based on the weight of the total composition, will usually be employed.

THE DISPERSANT

The adduct of this invention can be used with an auxiliary dispersant, which can comprise nitrogen or ester containing dispersants useful in this invention comprise members selected from the group consisting of (i) oil soluble salts, amides, imides, oxazolines and esters, or mixtures thereof, of long chain hydrocarbon substituted mono- and dicarboxylic acids or their anhydrides; (ii) long chain aliphatic hydrocarbon having a polyamine attached directly thereto; and (iii) Mannich condensation products formed by condensing about a molar proportion of long chain hydrocarbon substituted phenol with about 1 to 2.5 moles of formaldehyde and about 0.5 to 2 moles of polyalkylene polyamine; wherein said long chain hydrocarbon carbon group in (i), (ii) and (iii) is a polymer of a $C_2$ to $C_{10}$, e.g., $C_2$ to $C_5$ monoolefin, said polymer having a number average molecular weight of about 300 to about 5,000.

A(i) The long chain hydrocarbyl substituted mono- or dicarboxylic acid producing material, e.g., acid, anhydride, or ester, used in the invention includes a long chain hydrocarbon, generally a polyolefin, substituted typically with an average of at least about 0.8, usefully from about 1.0 to 2.0 (e.g., 1.0 to 1.6), preferably about 1.1 to 1.4 (e.g., 1.1 to 1.3) moles, per mole of polyolefin, of an alpha- or beta-unsaturated $C_4$ to $C_{10}$ dicarboxylic acid, anhydride or ester thereof, such as fumaric acid, itaconic acid, maleic acid, maleic anhydride, chloromaleic acid, dimethyl fumarate, chloromaleic anhydride, acrylic acid, methacrylic acid, crotonic acid, cinnamic acid, and mixtures thereof.

The preferred auxiliary dispersant is a long chain hydrocarbyl substituted dicarboxylic acid material, i.e., acid anhydride, or ester, and includes a long chain hydrocarbon, generally a polyolefin, substituted with an alpha or beta unsaturated $C_4$ to $C_{10}$ dicarboxylic acids, itaconic acid, maleic acid, maleic anhydride, chloromaleic acid, dimethyl fumarate, chloromaleic anhydride, etc. It may be aminated.

Preferred olefin polymers for the reaction with the unsaturated dicarboxylic acids are those polymers made up of a major molar amount of $C_2$ to $C_{10}$, e.g., $C_2$ to $C_5$, monoolefin. Such olefins include ethylene, propylene, butylene, isobutylene, pentene, octene-1, styrene, etc. The polymers may be homopolymers such as polyisobutylene or copolymers of two or more of such olefins. These include copolymers of: ethylene and propylene; butylene and isobutylene; propylene and isobutylene; etc. Other copolymers include those in which a minor molar amount of the copolymer monomers, e.g., 1 to 10 mole percent is a $C_4$ to $C_{18}$ non-conjugated diolefin, e.g., copolymer of isobutylene and butadiene; or a copolymer of ethylene, propylene and 1,4-hexadiene; etc.

In some cases, the olefin polymer may be completely saturated, for example an ethylene-propylene copolymer made by a Ziegler-Natta synthesis using hydrogen as a moderator to control molecular weight.

The olefin polymers will usually have number average molecular weights above about 700, and preferably from about 800 to 5,000. Particularly useful olefin polymers have number average molecular weights within the range of about 1,200 and about 5,000 with approximately one double bond per polymer chain. An especially suitable starting material for a dispersant additive is polyisobutylene. The number average molecular weight for such polymers can be determined by several known techniques. A convenient method for such determination is by gel permeation chromatography (GPC) which additionally provides molecular weight distribution information, see W. W. Yau, J. J. Kirkland and D. D. Bly, "Modern Size Exclusion Liquid Chromatography," John Wiley and Sons, New York, 1979.

Processes for reacting the olefin polymer with the $C_{4-10}$ unsaturated dicarboxylic acid, anhydride or ester are known in the art. For example, the olefin polymer and the dicarboxylic acid material may be simply heated together as disclosed in U.S. Pat. Nos. 3,361,673 and 3,401,118 to cause a thermal "ene" reaction to take place. Or, the olefin polymer can be first halogenated, for example, chlorinated or brominated to about 1 to 8, preferably 3 to 7 weight percent chlorine, or bromine, based on the weight of polymer, by passing the chlorine or bromine through the polyolefin at a temperature of 60° to 250°, e.g., 120° to 160° C. for about 0.5 to 10, preferably 1 to 7 hours. The halogenated polymer may then be reacted with sufficient unsaturated acid or anhydride at 100° to 250°, usually about 180° to 220° C. for about 0.5 to 10, e.g., 3 to 8 hours. Processes of this general type are taught in U.S. Pat. Nos. 3,087,436; 3,172,892; 3,272,746 and others.

Alternatively, the olefin polymer, and the unsaturated acid material are mixed and heated while adding chlorine to the hot material. Processes of this type are disclosed in U.S. Pat. Nos. 3,215,707; 3,231,587; 3,912,764; 4,110,349; 4,234,435; and in U.K. 1,440,219.

By the use of halogen, about 65 to 95 weight percent of the polyolefin will normally react with the dicarboxylic acid material. Thermal reactions, those carried out without the use of halogen or a catalyst, cause only about 50 to 75 weight percent of the polyisobutylene to react. Chlorination obviously helps to increase the reactivity. For convenience, all of the aforesaid functionality ratios of dicarboxylic acid producing units to polyolefin, e.g., 1.0 to 2.0, etc., are based upon the total amount of polyolefin, that is, the total of both the reacted and unreacted polyolefin, present in the resulting product formed in the aforesaid reactions.

The dicarboxylic acid producing materials can also be further reacted with amines, alcohols, including polyols, amino-alcohols, etc. to form other useful dispersant additives. Thus, if the acid producing material is to be further reacted, e.g., neutralized, then generally a major proportion of at least 50 percent of the acid units will be reacted.

Useful amine compounds for neutralization of the hydrocarbyl substituted dicarboxylic acid material include mono- and polyamines of about 2 to 60, e.g., 3 to 20, total carbon atoms and about 1 to 12, e.g., 2 to 9 nitrogen atoms in the molecule. These amines may be hydrocarbyl amines or may be hydrocarbyl amines including other groups, e.g., hydroxy groups, alkoxy groups, amide groups, nitriles, imidazoline groups, and the like. Hydroxy amines with 1 to 6 hydroxy groups, preferably 1 to 3 hydroxy groups are particularly useful. Preferred amines are aliphatic saturated amines, including those of the general formulas:

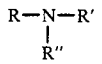

(Ia)

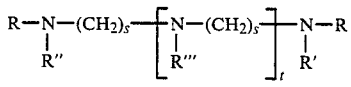

(Ib)

wherein R, R′, R″ and R‴ are independently selected from the group consisting of hydrogen; $C_1$ to $C_{25}$ straight or branched chain alkyl radicals; $C_1$ to $C_{12}$ alkoxy $C_2$ to $C_6$ alkylene radicals; $C_2$ to $C_{12}$ alkyl-amino $C_2$ to $C_6$ alkylene radicals; and wherein R‴ can additionally comprise a moiety of the formula:

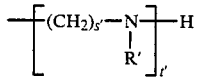

(Ic)

wherein R′ is as defined above, and wherein each s and s′ can be the same or a different number of from 2 to 6, preferable 2 to 4; and t and t′ can be the same or different and each numbers of from 0 to 10, preferably 2 to 7 with the proviso that the sum of t and t′ is not greater than 15. To assure a facile reaction, it is preferred that R, R′, R″, R‴, s, s′, t and t′ be selected in a manner sufficient to provide the compounds of Formulas Ia and Ib with typically at least one primary or secondary amine group, preferably at least two primary or secondary amine groups. This can be achieved by selecting at least one of said R, R′, R″ or R‴ groups of to be hydrogen or by letting t in Formula Ib be at least one when R‴ is H or when the (Ic) moiety possesses a secondary amino group. The most preferred amine of the above formulas are represented by Formula Ib and contain at least two primary amine groups and at least one, and preferably at least three, secondary amine groups.

Non-limiting examples of suitable amine compounds include: 1,2-diaminoethane; 1,3-diaminopropane; 1,4-diaminobutane; 1,6-diaminohexane; polyethylene amines such as diethylene triamine; triethylene tetramine; tetraethylene pentamine; polypropylene amines such as 1,2-propylene diamine; di-(1,2-propylene)triamine; di-(1,3-propylene)triamine; N,N-dimethyl-1,3-diaminopropane, N,N-di-(2-aminoethyl)ethylene diamine; N,N-di(2-hydroxyethyl)-1,3-propylene diamine; 3-dodecyloxypropyl-amine; N-dodecyl-1,3-propane diamine; tris hydroxymethylaminomethane (THAM); diisopropyl amine; diethanol amine; triethanol amine; mono-, di-, and tri-tallow amines; amino morpholines such as N-(3-aminopropyl)morpholine; and mixtures thereof.

Other useful amine compounds include: alicyclic diamines such as 1,4-di(aminoethyl)cyclohexane, and heterocyclic nitrogen compounds such as imidazolines, and N-aminoalkyl piperazines of the general formula (II):

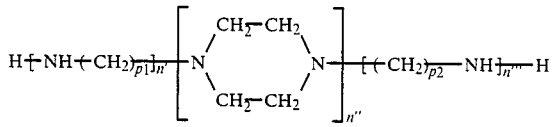

wherein $p_1$ and $p_2$ are the same or different and are each integers of from 1 to 4, and n′, n″ and n‴ are the same or different and are each integers of from 1 to 3. Non-limiting examples of such amines include 2-pentadecyl imidazoline; N-(2-aminoethyl)piperazine; etc.

Commercial mixtures of amine compounds may advantageously be used. For example, one process for preparing alkylene amines involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylenetetramine, tetraethylene pentamine and corresponding piperazines. Low cost poly(ethyleneamine) compounds averaging about 5 to 7 nitrogen atoms per molecular are available commercially under trade names such as "Polyamine H," "Polyamine 400," "Dow Polyamine E-100," etc.

Useful amines also include polyoxyalkylene polyamines such as those of the formulae:

$$NH_2\text{-alkylene}(\text{O-alkylene})_r NH_2 \quad \text{(III)}$$

where "r" has a value of about 3 to 70 and preferably 10 to 35; and $$R(\text{alkylene}(\text{O-alkylene})_q NH_2)_a \quad \text{(IV)}$$

where "q" has a value of about 1 to 40 with the provision that the sum of all the "q's" is from about 3 to about 70 and preferably from about 6 to about 35 and R is a polyvalent saturated hydrocarbon radical of up to ten carbon atoms wherein the number of substituents on the R group is represented by the value of "a", which is a number of 3 to 6. The alkylene groups in either formula (III) or (IV) may be straight or branched chains containing about 2 to 7, and preferably about 2 to 4 carbon atoms.

The polyoxyalkylene polyamines above, preferably polyoxyalkylene diamines and polyoxyalkylene triamines, may have average molecular weights ranging from about 200 to about 4,000 and preferably from about 400 to about 2,000. The preferred polyoxyalkylene polyamines include the polyoxyethylene and polyoxypropylene diamines and the polyoxypropylene triamines having average molecular weights ranging from about 200 to 2,000. The polyoxyalkylene polyamines are commercially available and may be obtained, for example, from the Jefferson Chemical Company, Inc. under the trade name "Jeffamines D-230, D-400, D-1000, D-2000, T-403," etc.

The amine is readily reacted with the dicarboxylic acid material, e.g., alkenyl succinic anhydride, by heating an oil solution containing 5 to 95 weight percent of dicarboxylic acid material to about 100° to 250° C., preferably 125° to 175° C., generally for 1 to 10, e.g., 2 to 6 hours, until the desired amount of water is removed. The heating is preferably carried out to favor formation of imides or mixtures of imides and amides, rather than amides and salts. Reaction ratios of dicarboxylic acid material to equivalents of amine as well as the other nucleophilic reactants described herein can vary considerably, depending upon the reactants and type of bonds formed. Generally from 0.1 to 1.0, preferably about 0.2 to 0.6, e.g. 0.4 to 0.6, moles of dicarboxylic acid moiety content (e.g. grafted maleic anhydride content) is used, per equivalent of nucleophilic reactant, e.g. amine. For example, about 0.8 mole of a pentamine (having two primary amino groups and 5 equivalents of nitrogen per molecule) is preferably used to convert into a mixture of amides and imides, the product formed by reacting one mole of olefin with sufficient maleic anhydride to add 1.6 moles of succinic anhydride groups per mole of olefin, i.e., preferably the pentamine is used in an amount sufficient to provide about 0.4 mole (that is $1.6+(0.8\times5)$ mole) of succinic anhydride moiety per nitrogen equivalent of the amine.

Preferred dispersants are polyisobutenyl succinimides ("PIBSA-PAM") derived from polyisobutenyl succinic anhydride, wherein the polyisobutenyl group has a number average molecular weight ($\overline{M}_n$) of from about 700 to 5,000, to $C_5$ to $C_9$ polyalkylene polyamines.

The nitrogen-containing dispersant can be further treated by boration as generally taught in U.S. Pat. Nos. 3,087,936 and 3,254,025 (the entirety of which is incorporated by reference). This is readily accomplished by treating said acyl nitrogen dispersant with a boron compound selected from the class consisting of boron oxide, boron halides, boron acids and esters of boron acids in an amount to provide from about 0.1 atomic proportion of boron for each mole of said acylated nitrogen composition to about 20 atomic proportions of boron for each atomic proportion of nitrogen of said acylated nitrogen composition. Usefully the dispersants of the inventive combination contain from about 0.05 to 2.0 weight percent, e.g., 0.05 to 0.7 weight percent, boron based on the total weight of said borated acyl nitrogen compound. The boron, which appears to be in the product as dehydrated boric acid polymer (primarily $(HBO_2)_3$), is believed to attach to the dispersant imides and diimides as amine salts, e.g., the metaborate salt of said diimide.

Treating is readily carried out by adding from about 0.05 to 4, e.g., 1 to 3 weight percent (based on the weight of said acyl nitrogen compound) of said boron compound, preferably boric acid, which is most usually added as a slurry to said acyl nitrogen compound and heating with stirring at from about 135° C. to 190° C., e.g., 140°–170° C., for from 1 to 5 hours followed by nitrogen stripping at said temperature ranges. Or, the boron treatment can be carried out by adding boric acid to the hot reaction mixture of the dicarboxylic acid material and amine while removing water.

Tris(hydroxymethyl)amino methane (THAM) can be reacted with the aforesaid acid material to form amides, imides or ester type additives as taught by U.K. Pat. No. 984,409, or to form oxazoline compounds and borated oxazoline compounds as described, for example, in U.S. Pat. Nos. 4,102,798; 4,116,876 and 4,113,639.

The ashless dispersants may also be esters derived from the long chain hydrocarbyl substituted dicarboxylic acid material and from hydroxy compounds such as monohydric and polyhydric alcohols or aromatic compounds such as phenols and naphthols, etc. The polyhydric alcohols are the most preferred hydroxy compound and preferably contain from 2 to about 10 hydroxy radicals, for example, ethylene glycol, diethylene glycol, triethylene glycol, tetraethylene glycol, dipropylene glycol, and other alkylene glycols in which the alkylene radical contains from 1 to about 8 carbon atoms. Other useful polyhydric alcohols include glycerol, mono-oleate of glycerol, monostearate of glycerol, monomethyl ether of glycerol, pentaerythritol, dipentaerythritol, and mixtures thereof.

The ester dispersant may also be derived from unsaturated alcohols such as allyl alcohol, cinnamyl alcohol, propargyl alcohol, 1-cyclohexane-3-ol, and oleyl alcohol. Still other classes of the alcohols capable of yielding the esters of this invention comprise the ether-alcohols and amino-alcohols including, for example, the oxy-alkylene, oxy-arylene-, amino-alkylene-, and amino-arylene-substituted alcohols having one or more oxy-alkylene, amino-alkylene or amino-arylene oxy-arylene radicals. They are exemplified by Cellosolve, Carbitol, N,N,N',N'-tetrahydroxy-trimethylene diamine, and ether-alcohols having up to about 150 oxy-alkylene radicals in which the alkylene radical contains from 1 to about 8 carbon atoms.

The ester dispersant may be di-esters of succinic acids or acidic esters, i.e., partially esterified succinic acids; as well as partially esterified polyhydric alcohols or phenols, i.e., esters having free alcohols or phenolic hydroxyl radicals. Mixtures of the above illustrated esters likewise are contemplated within the scope of this invention.

The ester dispersant may be prepared by one of several known methods as illustrated for example in U.S. Pat. No. 3,381,022.

Hydroxyamines which can be reacted with the long chain hydrocarbon substituted dicarboxylic acid material mentioned above to form dispersants include 2-amino-1-butanol, 2amino-2-methyl-1-propanol, p-(beta-hydroxyethyl)-aniline, 2-amino-1-propanol, 3-amino-1-propanol, 2-amino-2-methyl-1,3-propane-diol, 2-amino-2-ethyl-1,3-propanediol,N-(beta-hydroxy-propyl)-N'-(beta-amino-ethyl)piperazine, tris(hydroxymethyl-)amino-methane (also known as trismethylolaminomethane), 2-amino-1-butanol, ethanolamine, beta-(beta-hydroxyethoxy)-ethylamine, and the like. Mixtures of these or similar amines can also be employed.

A very suitable ashless dispersant is one derived from polyisobutylene substituted with succinic anhydride groups and reacted with polyethylene amines, e.g., tetraethylene pentamine, pentaethylene hexamine, polyoxyethylene and polyoxypropylene amines, e.g., polyoxypropylene diamine, trismethylolaminomethane and pentaerythritol, and combinations thereof. One preferred dispersant combination involves a combination of (A) polyisobutane substituted with succinic anhydride groups and reacted with (B) a hydroxy compound, e.g., pentaerythritol, (C) a polyoxyalkylene polyamine, e.g., polyoxypropylene diamine, and (D) a polyalkylene polyamine, e.g., polyethylene diamine and tetraethylene pentamine using about 0.3 to about 2 moles each of (B) and (D) and about 0.3 to about 2 moles of (C) per mole of (A) as described in U.S. Pat. No. 3,804,763. Another preferred dispersant combination involves the combination of (A) polyisobutenyl succinic anhydride with (B) a polyalkylene polyamine, e.g., tetraethylene pentamine, and (C) a polyhydric alcohol or polyhydroxy-substituted aliphatic primary amine, e.g., pentaerythritol or trismethylolaminomethane as described in U.S. Pat. No. 3,632,511.

A(ii) Also useful as ashless nitrogen-containing dispersant in this invention are dispersants wherein a nitrogen containing polyamine is attached directly to the long chain aliphatic hydrocarbon as shown in U.S. Pat.

Nos. 3,275,554 and 3,565,804 where the halogen group of the halogenated hydrocarbon is displaced with various alkylene polyamines.

A(iii) Another class of nitrogen containing dispersants which may be used are those containing Mannich base or Mannich condensation products as they are known in the art. Such Mannich condensation products generally are prepared by condensing about 1 mole of a high molecular weight hydrocarbyl substituted mono- or polyhydroxy benzene (e.g., having a number average molecular weight of 1,000 or greater) with about 1 to 2.5 moles of formaldehyde or paraformaldehyde and about 0.5 to 2 moles polyalkylene polyamine as disclosed, e.g., in U.S. Pat. Nos. 3,442,808; 3,649,229 and 3,798,165 (the disclosures which are hereby incorporated by reference in their entirety). Such Mannich condensation products may include a long chain, high molecular weight hydrocarbon on the phenol group or may be reacted with a compound containing such a hydrocarbon, e.g., polyalkenyl succinic anhydride as shown in said aforementioned U.S. Pat. No. 3,442,808.

DETERGENTS

Metal-containing rust inhibitors and/or detergents are frequently used as ashless dispersants. Such detergents and rust inhibitors include the metal salts of sulfonic acids, alkyl phenols, sulphurized alkyl phenols, alkyl salicylates, naphthenates, and other oil soluble mono- and di-carboxylic acids. Highly basic (or "overbased") metal salts, which are frequently used as detergents, appear particularly prone to interaction with the ashless dispersant. Usually these metal-containing rust inhibitors and detergents are used in lubricating oil in amounts of about 0.01 to 10, e.g., 0.1 to 5, weight percent, based on the weight of the total lubricating composition.

Highly basic alkaline earth metal sulfonates are frequently used as detergents. They are usually produced by heating a mixture comprising an oil-soluble sulfonate or alkaryl sulfonic acid, with an excess of alkaline earth metal compound above that required for complete neutralization of any sulfonic acid present and thereafter forming a dispersed carbonate complex by reacting the excess metal with carbon dioxide to provide the desired overbasing. The sulfonic acids are typically obtained by the sulfonation of alkyl substituted aromatic hydrocarbons such as those obtained from the fractionation of petroleum by distillation and/or extraction or by the alkylation of aromatic hydrocarbons as for example those obtained by alkylating benzene, toluene, xylene, naphthalene, diphenyl and the halogen derivatives such as chlorobenzene, chlorotoluene or chloronaphthalene. The alkylation may be carried out in the presence of a catalyst with alkylating agents having from about 3 to more than 30 carbon atoms. For example, haloparaffins, olefins obtained by dehydrogenation of paraffins, polyolefin polymers produced from ethylene, propylene, etc. are all suitable. The alkaryl sulfonates usually contain from about 9 to about 70 or more carbon atoms, preferably from about 16 to about 50 carbon atoms per alkyl substituted aromatic moiety.

The alkaline earth metal compounds which may be used in neutralizing these alkaryl sulfonic acids to provide the sulfonates includes the oxides and hydroxides, alkoxides, carbonates, carboxylate, sulfide, hydrosulfide, nitrate, borates and ethers of magnesium, calcium, strontium and barium. Examples are calcium oxide, calcium hydroxide, magnesium oxide, magnesium acetate and magnesium borate. As noted, the alkaline earth metal compound is used in excess of that required to complete neutralization of the alkaryl sulfonic acids. Generally, the amount ranges from about 100 to 220 percent, although it is preferred to use at least 125 percent, of the stoichiometric amount of metal required for complete neutralization.

Various other preparations of basic alkaline earth metal alkaryl sulfonates are known, such as U.S. Pat. Nos. 3,150,088 and 3,150,089 wherein overbasing is accomplished by hydrolysis of an alkoxide-carbonate complex with the alkaryl sulfonate in a hydrocarbon solvent-diluent oil.

A preferred alkaline earth sulfonate additive is magnesium alkyl aromatic sulfonate having a high total base number ("TBN") ranging from about 300 to about 400 with the magnesium sulfonate content ranging from about 25 to about 32 weight percent, based upon the total weight of the additive system dispersed in mineral lubricating oil.

Neutral metal sulfonates are frequently used as rust inhibitors. Polyvalent metal alkyl salicylate and naphthenate materials are known additives for lubricating oil compositions to improve their high temperature performance and to counteract deposition of carbonaceous matter on pistons (U.S. Pat. No. 2,744,069). An increase in reserve basicity of the polyvalent metal alkyl salicylates and naphthenates can be realized by utilizing alkaline earth metal, e.g., calcium, salts of mixtures of $C_8$–$C_{26}$ alkyl salicylates and phenates (see U.S. Pat. No. 2,744,069) or polyvalent metal salts of alkyl salicylic acids, said acids obtained from the alkylation of phenols followed by phenation, carboxylation and hydrolysis (U.S. Pat. No. 3,704,315) which could then be converted into highly basic salts by techniques generally known and used for such conversion. The reserve basicity of these metal-containing rust inhibitors is usefully at TBN levels of between 60 and 150. Included with the useful polyvalent metal salicylate and napthenate materials are the methylene and sulfur bridged materials which are readily derived from alkyl substituted salicyclic or naphthenic acids or mixtures of either of both with alkyl substituted phenols. Basic sulfurized salicylates and a method for their prepration is shown in U.S. Pat. No. 3,595,791. Such materials include alkaline earth metal, particularly magnesium, calcium, strontium and barium salts of aromatic acids having the general formula:

$$HOOC—ArR'—X'y(ArR'OH)_n \quad (V)$$

where Ar is an aryl radical of 1 to 6 rings, R' is an alkyl group having from about 8 to 50 carbon atoms, preferably 12 to 30 carbon atoms (optimumally about 12), X' is a sulfur (—S—) or methylene (—$CH_2$—) bridge, y is a number from 0 to 4, and n is a number from 0 to 4.

Preparation of the overbased methylene bridge salicylate-phenate salt is readily carried out by conventional techniques such as by alkylation of a phenol followed by phenation, carboxylation, hydrolysis, methylene bridging a coupling agent such as an alkylene dihalide followed by salt formation concurrent with carbonation. An overbased calcium salt of a methylene bridged phenol-salicyclic acid of the general formula:

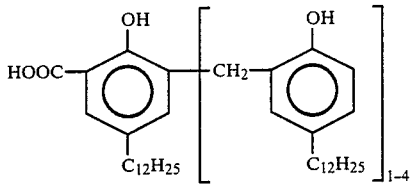

(VI)

with a TBN of 60 to 150 is highly useful in this invention.

The sulfurized metal phenates can be considered the "metal salt of a phenol sulfide" which thus refers to a metal salt whether neutral or basic, of a compound typified by the general formula:

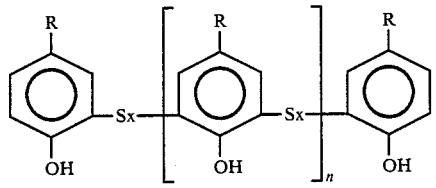

(VII)

where x=1 or 2, n=0, 1 or 2 or a polymeric form of such a compound, where R is an alkyl radical, n and x are each integers from 1 to 4, and the average number of carbon atoms in all of the R groups is at least about 9 in order to ensure adequate solubility in oil. The individual R groups may each contain from 5 to 40, preferably 8 to 20, carbon atoms. The metal salt is prepared by reacting an alkyl phenol sulfide with a sufficient quantity of metal containing material to impart the desired alkalinity to the sulfurized metal phenate.

Regardless of the manner in which they are prepared, the sulfurized alkyl phenols which are useful generally contain from about 2 to about 14 percent by weight, preferably about 4 to about 12 weight percent sulfur based on the weight of sulfurized alkyl phenol.

The sulfurized alkyl phenol may be converted by reaction with a metal containing material including oxides, hydroxides and complexes in an amount sufficient to neutralize said phenol and, if desired, to overbase the product to a desired alkalinity by procedures well known in the art. Preferred is a process of neutralization utilizing a solution of metal in a glycol ether.

The neutral or normal sulfurized metal phenates are those in which the ratio of metal to phenol nucleus is about 1:2. The "overbased" or "basic" sulfurized metal phenates are sulfurized metal phenates wherein the ratio of metal to phenol is greater than that of stoichiometric, e.g., basic sulfurized metal dodecyl phenate has a metal content up to (or greater) than 100 percent in excess of the metal present in the corresponding normal sulfurized metal phenates. The excess metal is produced in oil-soluble or dispersible form (as by reaction with $CO_2$).

ANTIWEAR ADDITIVES

Dihydrocarbyl dithiophosphate metal salts are frequently added to lubricating oil compositions as antiwear agents. They also provide antioxidant activity. The zinc salts are most commonly used in lubricating oil in amounts of 0.1 to 10, preferably 0.2 to 2 weight percent, based upon the total weight of the lubricating oil composition. They may be prepared in accordance with known techniques by first forming a dithiophosphoric acid, usually by reaction of an alcohol or a phenol with $P_2S_5$ and then neutralizing the dithiophosphoric acid with a suitable zinc compound.

Mixtures of alcohols may be used including mixtures of primary and secondary alcohols, secondary generally for importing improved antiwear properties, with primary giving improved thermal stability properties. Mixtures of the two are particularly useful. In general, any basic or neutral zinc compound could be used but the oxides, hydroxides and carbonates are most generally employed. Commercial additives frequently contain an excess of zinc due to use of an excess of the basic zinc compound in the neutralization reaction.

The zinc dihydrocarbyl dithiophosphates useful in the present invention are oil soluble salts of dihydrocarbyl esters of dithiophosphoric acids and may be represented by the following formula:

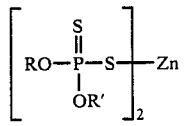

(VIII)

wherein R and R′ may be the same or different and are hydrocarbyl radicals containing from 1 to 18, preferably 2 to 12 carbon atoms and including radicals such as alkyl, alkenyl, aryl, aralkyl, alkaryl and cycloaliphatic radicals. Particularly preferred as R and R′ groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl, etc. In order to obtain oil solubility, the total number of carbon atoms (i.e., R and R′) in the dithiophosphoric acid generally should be about 5 or greater.

ANTIOXIDANTS

Materials which have been observed to be effective antioxidants in lubricating oil compositions are oil-soluble copper compounds e.g., synthetic or natural carboxylic acid Cu salts. Examples include $C_{10}$ to $C_{18}$ fatty acids such as stearic or palmitic acid. But unsaturated acids (such as oleic acid), branched carboxylic acids (such as naphthenic acids) of molecular weight from 200 to 500 and, synthetic carboxylic acids are all used because of the acceptable handling and solubility properties of the resulting cooper carboxylates.

Suitable oil soluble dithiocarbamates have the general formula $(R_{11}R_{12}NCSS)_nCu$; where n is 1 or 2 and $R_{11}$ and $R_{12}$ may be the same or different and are hydrocarbyl radicals containing from 1 to 18 carbon atoms and including radicals such as alkyl, alkenyl, aryl, aralkyl, alkaryl and cycloaliphatic radicals. Particularly preferred as $R_{11}$ and $R_{12}$ groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl butyl-phenyl, cyclohexyl, methylcyclopentyl, propenyl, butenyl, etc. In order to obtain oil solubility, the total number of carbon atoms (i.e., $R_{11}$ and $R_{12}$) generally should be about 5 or greater.

Copper sulphonates, phenates, and acetyl acetones may also be used.

These antioxidants are used in amounts such that, in the final lubricating or fuel composition, a copper concentration of from about 1 to about 500 ppm is present.

COMPATIBILITY AIDS

As has been noted before, this invention is to lubricating oil and concentrate compositions containing polyolefinic succinimide polyamine alkyl acetoacetate or substituted acetic anhydride adducts of the general formula (IX):

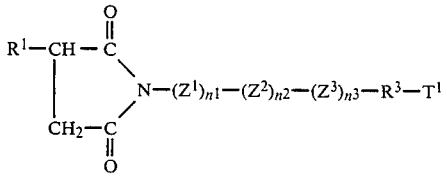

wherein $Z^1$ and $Z^3$ are the same or different and are moities of the formula:

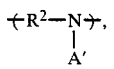

$Z^2$ is a moiety of the formula:

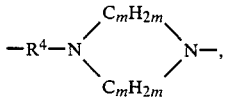

wherein $R^2$, $R^3$ and $R^4$ are the same or different and are alkylene of from 1 to 6 carbon atoms, m is an integer of from 1 to 5, each A' is independently selected from the group consisting of H, A and the moiety:

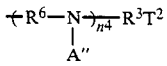

wherein A'' is H or A, $R^3$ is as defined above, $R^6$ is alkylene of from 1 to 6 carbon atoms, $T^1$ and $T^2$ are the same or different and each comprises a member selected from the group consisting of moieties of the formula:

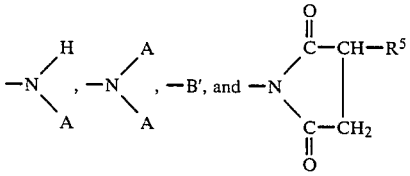

wherein B' is substituted or unsubstituted alkyl or aryl-containing group, $n^1$ is an integer of 0 to 10, $n^2$ is an integer of 0 to 10, $n^3$ is an integer of from 0 to 10, $n^4$ is an integer of from 0 to 10, with the proviso that the sum of $n^1$, $n^2$, $n^3$ and $n^4$ is from 3 to 10 and the sum of $n^1$, $n^3$ and $n^4$ is at least 1, wherein $R^1$ and $R^5$ are independently an olefin polymer having a number average molecular weight ($\overline{M}_n$) between about 650 and 3,500, and wherein A comprises:

(i) a substituted acetyl moiety of the formula (IXa):

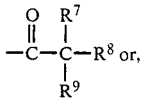

(ii) a tautomeric substituent of the formula (IXb):

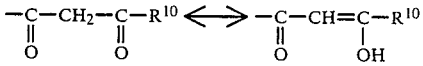

wherein $R^7$, $R^8$ and $R^9$ are the same or different and are H or alkyl of from 1 to 4 carbon atoms, and wherein $R^{10}$ is substituted or unsubstituted alkyl or aryl containing groups, with the proviso that at least one of the A' or A'' groups comprises said substituted acetyl or said tautomeric substituent.

The $R^1$ and $R^5$ groups may be the same or different and may be olefinic polymeric residues produced from $C_2$ to $C_{10}$ mono-olefins. Such olefins may be ethylene, propylene, butylene, isobutylene, pentene, octene-1, styrene, etc. The polymers can be homopolymers such as polyisobutylene, as well as copolymers of two or more of such olefins such as copolymers of: ethylene and propylene; butylene and isobutylene; propylene and isobutylene; etc., other copolymers are those in which a minor molar amount of the copolymer monomers, e.g., 1 to 10 mole %, is a $C_4$ to $C_{18}$ non-conjugated diolefin, e.g., a copolymer of isobutylene and butadiene; or a copolymer of ethylene, propylene and 1,4-hexadiene; etc.

The olefin polymer may be completely saturated as in the example of an ethylene-propylene copolymer made by Ziegler-Natta synthesis using hydrogen as a moderator to control molecular weight.

The olefinic polymer will usually have number average molecular weights within the range of about 650 and about 3500, more usually between about 1200 and about 3500. Particularly useful olefin polymers have number average molecular weights within the range of about 1500 and about 3000 with approximately one double bond per polymer chain. An especially useful starting material is polyisobutylene.

The $R^2$, $R^4$ and $R^6$ groups are alkylene linkages having from 1 to 6 carbon atoms. The preferred linkage is a $C_2$ to $C_4$ (e.g., $—CH_2—$, $—C_2H_4—$, $—C_3H_6—$, and $—C_4H_8—$) link. Most preferred is an ethylene ($—C_2H_4—$) linkage.

Preferably, when $n^2$ is zero, the value of $n^1$ is from 1 to 5, $n^3$ is from 0 to 5, and $n^4$ is from 0 to 5, and the sum of integers $n^1$, $n^3$ and $n^4$ is preferably from 2 to 10, and more preferably from 3 to 7. When $n^2$ is not zero, preferably each A' is independently selected from H or A, and the value of $n^1$ is from 1 to 5, $n^2$ is from 1 to 3, $n^3$ is from 0 to 5, and the total of integers $n^1$, $n^2$ and $n^3$ is from 2 to 10, and more preferably from 3 to 7.

$R^{10}$ may be a substitued or unsubstituted alkyl or aryl containing group but desirably is a lower alkyl having 1 to 4 carbon atoms (e.g., ethyl, butyl, propyl) and preferably is a methyl group.

As noted above $T^1$ and $T^2$ may be either secondary or tertiary amine-containing groups of the formula:

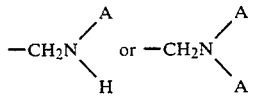

or polyolefin substituted succinimide-containing groups of the formula:

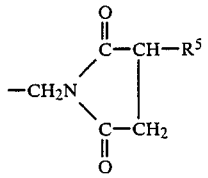

or a substituted or unsubstituted aryl or alkyl group, e.g., alkaryl of 7 to 12 carbon atoms, alkyl of 1 to 25 carbon atoms, preferably alkyl of 1 to 6 carbon atoms.

Mixtures of adducts fitting the above description are within the scope of the invention.

Exemplary of adducts of this invention derived from cyclic alkylene polyamines are adducts of the formula IX wherein $n^1$, $n^2$ and $n^3$ are each integers of 1 to 3, $R^2$ and $R^4$ are each $C_2$ to $C_4$ alkylene, A' is A, $n^4$ is an integer of 1 to 3, $R^3$ is $—CH_2CH_2—$, $T^1$ is

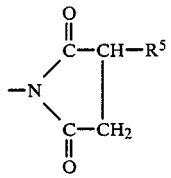

or —NH(A), A is the tautomeric substitutent of the formula IXb wherein $R^{10}$ is $C_1$ to $C_2$ alkyl, and wherein $R^1$ and $R^5$ are the same or different and are polyalkylene (especially, polyisobutylene or polybutylene) having $\overline{M}_n$ of from 1,500 to 3,000. Illustrative such adducts are those of the formula (X):

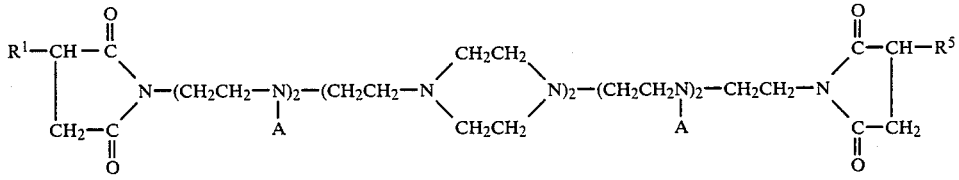

Wherein $R^1$, $R^5$ and A are as defined in the prior sentence.

Exemplary of adducts of this invention derived from straight and branched chain polyalkylene polyamines are adducts of formula IX wherein $n^2$ is zero, $n^1$ and $n^3$ are each integers of from 1 to 3, $R^2$ is $C_2$ to $C_4$ alkylene, each A' is:

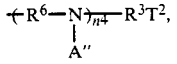

$R^3$ is $—CH_2CH_2—$, $n^4$ is an integer of 1 to 3, $R^6$ is $C_2$ to $C_4$ alkylene, $T^1$ and $T^2$ are as defined in formula IX, A is the tautomeric substituent of formula (IXb) wherein $R^{10}$ is $C_1$ to $C_2$ alkyl, and $R^1$ and $R^5$ are the same or different and are polyalkylene having $\overline{M}_n$ of from 1,500 to 3,000. Exemplary of adducts derived from such branched chain polyalkylene polyamines are adducts of the formula (XI):

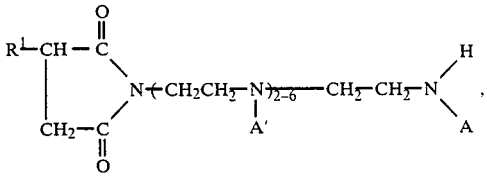

wherein A' is:

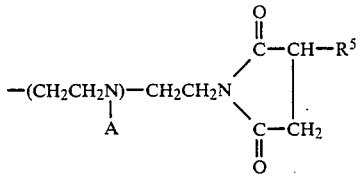

wherein $R^1$, A and $R^5$ are as defined in the prior sentence. Exemplary of adducts derived from straight chain polyalkylene polyamines are adducts of formula (XI) wherein A' is H or A.

Adducts of this invention derived from straight chain polyalkylene polyamines are preferred.

Exemplary of preferred compatibilizer adducts of this invention are:

(XII)

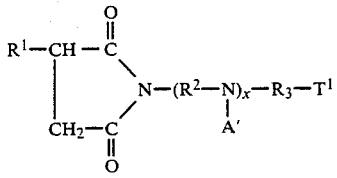

wherein A' is A, and wherein $R^1$, $R^2$, $R^3$, and $T^1$ as defined in Table I below:

TABLE I

| $R^1$ | x | $R^2$ | $R^3$ | $R^{10}$ of Each A(1) | $T^1$ |
|---|---|---|---|---|---|
| Derived from: | | | | | |
| polyisobutylene $\overline{M}_n$ = 700 | 5 | $—C_2H_4—$ | $—CH_2CH_2—$ | $—CH_3$ | —NH(A), $R^{10}$ = $—CH_3$ |
| polyisobutylene | 3 | $—CH_2—$ | $—C_3H_6—$ | $—C_2H_5$ | —NH(A), |

TABLE I-continued

| $R^1$ | x | $R^2$ | $R^3$ | $R^{10}$ of Each A(1) | $T^1$ |
|---|---|---|---|---|---|
| $\overline{M}_n$ = 2,200 polybutene | 4 | $-C_5H_{10}-$ | $-C_4H_8-$ | $-H$ | $R^{10} = -CH_3$ $-NH(A)_2$, |
| $\overline{M}_n$ = 1,200 polybutene | 2 | $-C_2H_4-$ | $-C_2H_4-$ | $-C_2H_5$ | $R^{10} = -H$ $-NH(A)_2$, |
| $\overline{M}_n$ = 4,000 polypentene | 5 | $-C_3H_6-$ | $-C_3H_6-$ | $-C_4H_9$ | $R^{10} = -C_2H_5$ $-N(A)_2$, |
| $\overline{M}_n$ = 1,800 | | | | | $R^{10} = -C_4H_9$ |
| ethylene-propylene co-polymer $\overline{M}_n$ = 3,000 | 2 | $-C_2H_4-$ | $-C_2H_4-$ | $-CH_3$ | $-N(H)(A)$, $R^{10} = -CH_3$ |
| polyisobutylene $\overline{M}_n$ = 1,500 | 2 | $-C_2H_4-$ | $-C_2H_4-$ | $-CH_3$ | (2) |

Notes:
(1) Wherein A = the tautomeric substituent of formula IXb.

(2) $T^1 = -N(C(O)-CH(R^5)-C(O)-CH_2)$, wherein $R^5$ = polyisobutylene, $\overline{M}_n$ = 1,500

These adducts may be made in a variety of ways. Certain portions of the reaction scheme are believed to be important in producing the described molecule. Those steps will be high-lighted at appropriate junctures.

The step in this process which produces certain of the above adducts is the reaction of an alkyl acetoacetate:

$$R^{10}-\underset{\underset{O}{\|}}{C}-CH_2-\underset{\underset{O}{\|}}{C}-O-R^{15} \quad \text{(XIII)}$$

or an alkyl thioacetate:

$$R^{10}-\underset{\underset{O}{\|}}{C}-CH_2-\underset{\underset{O}{\|}}{C}-S-R^{15} \quad \text{(XIV)}$$

(wherein $R^{10}$ is as defined above and $R^{15}$ is H or alkyl or 1 to 5 carbon atoms) substituted or unsubstituted alkyl or aryl, and preferably is alkyl of with a long chain polyolefinic dicarboxylic acid which has been aminated with a polyamine, such as the saturated aliphatic amines, alicylic diamines, polyoxyalkylene polyamines of formulae Ia, Ib, II, III and IV, discussed above. This reaction should be practiced at a temperature sufficiently high to produce substantial amounts of the tautomeric keto-enol rather than the enaminone. Generally, temperatures of from 120° to 220° C. will be suitable, with 150° to 180° C. being preferred. The reaction of the animated polyolefinic dicarboxylic acid material and the alkyl acetonate and the alkyl thioacetate will liberate the corresponding $HOR^{15}$ and $HSR^{15}$ by-products, respectively. Preferably, such by-products are substantially removed, as by distillation or stripping with an inert gas (such as $N_2$), prior to use of the adduct as described herein. Such distillation and stripping steps are conveniently performed at elevated temperature, e.g., at the selected reaction temperature (for example, at 150° C. or higher).

The amount of alkyl aceto-acetate and/or alkyl thioacetate reacants used can vary widely, and is preferably selected so as to avoid substantial excesses of these reactants. Generally, these reactants are used in a reactant:amine nitrogen-equivalent molar ratio of from about 0.1 to 1:1, and preferably from about 0.5 to 1:1, wherein the moles of amine nitrogen-equivalent is the moles of secondary nitrogens plus twice the moles of primary nitrogens in the animated polyolefinic dicarboxylic acid material (e.g., PIBSA-PAM) which is thus contacted with the alkyl acetonate or alkyl thioacetate. The reaction should also be conducted in the substantial absence of strong acids (e.g., mineral acids, such as HCl, $HB_2$, $H_2SO_4$, $H_3PO_3$ and the like, and sulfonic acids, such as para-toluene sulfonic acids) to avoid the undesired side-reactions and decrease in yield to the adducts of this invention.

Methods for producing the long chain polyolefinic dicarboxylic acid substrate and the subsequent amination are known and are discussed above.

Such long chain polyolefinic dicarboxylic acid substrates can be illustrated by compounds of the formula:

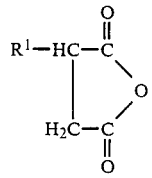

(XV)

wherein $R^1$ is as defined above, or the corresponding diacid

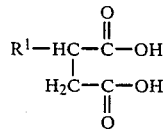

(XVI)

wherein $R^1$ is as defined above, or mixtures thereof.

The resulting animated polyolefinic dicarboxylic acid substrate materials prepared from polyalkylene polyamines can be illustrated by the general formulae:

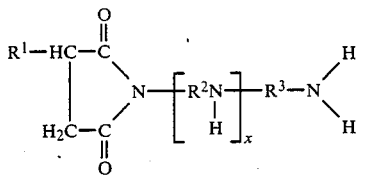

(XVII)

or

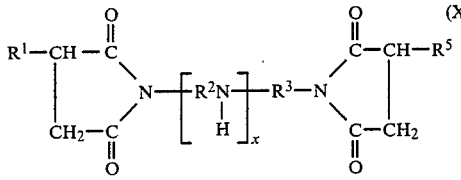

(XVIII)

wherein x is an integer of 1 to 10, and $R^1$, $R^2$, $R^3$ and $R^5$ are as defined above for formula IX.

Typically, they will be produced in mixtures of the two.

The polyolefinic dicarboxylic acid substrate material, after amination, may then be reacted with an alkyl acetoacetate or thioacetate discussed above, at a temperature sufficiently high and substantially to minimize the production of the enaminone and form, instead, the keto-enol tautomer of formula IXb. Temperatures of about 150° C., or more, are preferred to meet this goal although proper choice of temperature depends on many factors, including reactants, concentration, reaction solvent choice, etc.

The polyolefinic dicarboxylic acid substrate material, after amination, may instead be reacted with a substituted acetic anhydride of the formula:

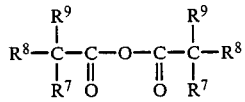

(XIX)

where $R^7$, $R^8$ and $R^9$ are independently H or lower alkyl having from 1 to 4 carbon atoms. An especially appropriate reactant is trimethyl acetic anhydride of the formula:

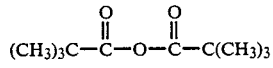

(XX)

Reaction conditions are similar to those used for the alkyl acetoacetate except that the temperature need not be quite so high, e.g., above about 125° C.

The ashless dispersant, metal detergent, antiwear agent and compatibilizing material of the present invention will be generally used in admixture witth a lube oil basestock, comprising an oil of lubricating viscosity, including natural and synthetic lubricating oils and mixtures thereof. The lubricating oil base stock conveniently has a viscosity of typically about 2.5 to about 12, and preferably about 2.5 to about 9 cs. at 100° C.

Natural oils include animal oils and vegetable oils (e.g., castor, lard oil) liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhxyl)benzenes); polyphenyls (e.g., biphenyls, terphenyls, alkylated polyphenols); and alkylated diphenyl ethers and alkylated diphenyl sulfides and the derivatives, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, the alkyl and aryl ethers of these polyoxyalkylene polymers (e.g., methyl-polyisopropylene glycol ether having an average molecular weight of 1000, diphenyl ether of poly-ethylene glycol having a molecular weight of 500–1000, diethyl ether of polypropylene glycol having a molecular weight of 1000–1500); and mono- and polycarboxylic esters thereof, for example, the acetic acid esters, mixed $C_3$–$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol and tripentaerthritol.

Silicon-based oils such as the polyalkyl-, polyaryl-, polyalkoxy-, or polyaryloxysiloxne oils and silicate oils comprise another useful class of synthetic lubricants; they include tetraethyl silicate, tetraisopropyl silicate, tetra-(2-ethylhexyl)silicate, tetra-(4-methyl-2-ethylhexyl)silicate, tetra-(p-tert-butylphenyl)silicate, hexa-(4-methyl-2-pentoxy)disiloxane, poly(methyl)siloxanes and poly(methylphenyl)siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and rerefined oils can be used in the lubricants of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Rerefined oils are obtained by processes similar to those used to obtain refined oils applied to refined oils which have been already used in service. Such rerefined oils are also known as reclaimed or reprocessed oils and often are additionally processed by techniques for removal of spent additives and oil breakdown products.

The stabilized ad packs of this invention may be blended with base oil and the following additives in amounts effective to provide their normal attendant functions. These additive effective amounts are illustrated as follows:

| Additive | Preferred (Wt. % A.I.) | Broad (Wt. % A.I.) |
|---|---|---|
| Adduct Compatibilizers | 0.1–8 | .01–10 |
| Viscosity Modifier | 0.1–4 | .01–12 |
| Corrosion Inhibitor | 0.01–1.5 | .01–5 |
| Oxidation Inhibitor | 0.01–1.5 | .01–5 |
| Dispersants (Total) | 0.1–8 | .01–20 |
| Pour Point Depressant | 0.01–1.5 | .01–5 |
| Antifoaming Agents | 0.001–0.15 | .001–3 |
| Antiwear Agents | 0.001–1.5 | .001–5 |
| Detergents/Rust Inhibitors | 0.01–3 | .01–20 |
| Friction Modifiers | 0.01–1.5 | .01–5 |
| Mineral Oil Base | Balance | Balance |

Dissolution of the additive concentrate into the lubricating oil may be facilitated by solvents and by mixing accompanied with mild heating, but this is not essential. The concentrate or additive-package will typically be formulated to contain the additives in proper amounts to provide the desired concentration in the final formulation when the additive-package is combined with a predetermined amount of base lubricant. The final formulations may employ typically about 10 wt. % of the additive-package with the remainder being base oil.

All of said weight percents expressed herein are based on active ingredient (A.I.) content of the additive, and/or upon the total weight of any additive-package, or formulation which will be the sum of the A.I. weight of each additive plus the weight of total oil or diluent.

This invention is further illustrated by the examples which follow. The examples are not intended to limit the scope of the invention in any way.

EXAMPLES

Example 1 (PIBSA-PAM-TMA)

About 1000 g of a dispersant made by reacting a polyamine (PAM) with polyisobutylene succinic anhydride (PIBSA) at a molar ratio of 2.0 moles of PIBSA per mole of PAM, wherein the PIB had a number average molecular weight of 2250 and a SA:PIB ratio of 1.07, was mixed with 133 g of trimethyl acetic anhydride (TMA) and slowly heated to 130° C. for 1.5 hours. Thereafter the reaction mixture was heated to 150° C. and nitrogen stripped for one hour. The 50% oil solution dispersant analyzed was 0.97 wt. % and N had a kinematic viscosity of 1089 cSt at 100° C.

Example 2 (PIBSA-PAM-EAA)

About 2435 g of the PIBSA-PAM dispersant used in Example 1 was mixed with 155 g of ethyl acetoacetate, 101 g of S150N oil, and heated to 150°–160° C. for 2 hours while stirring under a nitrogen blanket. Thereafter the reaction mixture was nitrogen stripped at 150°–160° C. for one and a half hours. The 50% oil solution analyzed for 0.96% nitrogen. Additive packages suitable for blending with a base oil stock to produce a lubricating oil formulation were mixed to test for compatibility of the included additives.

Example 3

Ad packs I and II were prepared by blending (as dispersant) the PIBSA-PAM starting material of Example 1 and the PIBSA-PAM-TMA product made according to Example 1, respectively, with an overbased magnesium sulfonate detergent, a ZDDP antiwear material, nonyl phenol disulfide, a copper oleate antioxidant and S150N diluent oil. The level and proportion of the recited components were the same in each Ad Pack, except for use of the different dispersants.

The Ad Packs were then tested for storage stability at elevated temperatures:

| AD PACK | STABILITY (DAYS) 54° C. | 66° C. |
|---|---|---|
| I (Comparative) | 0 | 0 |
| II | >84 | >84 |

The ad pack not containing the inventive compatibility aid was unstable and separated immediately. Ad pack II remained mixed with no separation at the end of the 84 day test.

Example 4

Ad packs III and IV were prepared with the same ingredients in the same proportions as were ad packs I and II, except that the level of diluent oil was increased and the overbased magnesium sulfonate detergent was from another commerical source. Ad pack III contained the Example 1 PIBSA-PAM starting material (which had been borated) while ad pack IV contained the PIBSA-PAM-EAA product made according to Example 2.

The storage stability test provided the following results:

| AD PACK | STABILITY (DAYS) 130° F. | 150° F. |
|---|---|---|
| III (Comparative) | 0 | 0 |
| IV | >61 | 32 |

The acetoacetate adduct provided substantially improved stability to the ad pack mixture.

The invention has been described by specific disclosure and by examples. It will be apparent to those skilled in the art that various changes and modifications to the claimed invention may be made which fall into the scope of equivalents.

We claim as our invention:

1. An oleaginous composition comprising:

(a) from about 1 to 70 wt.% of an ashless nitrogen or ester containing dispersant compound selected from the group consisting of:

(i) oil soluble salts, amides, imides, oxazolines and esters, or mixtures thereof, of long chain hydrocarbon substituted mono- and dicarboxylic acids or their anhydrides;

(ii) long chain aliphatic hydrocarbon having a polyamine attached directly thereto; and (iii) Mannich condensation products formed by condensing about a molar proportion of long chain hydrocarbon substituted phenol with about 1 to 2.5 moles of formaldehyde and about 0.5 to 2 moles of polyalkylene polyamine, wherein said long chain hydrocarbon group in (i), (ii), or (iii) is a polymer of a $C_2$ to $C_5$ monoolefin, said polymer having a molecular weight of about 700 to about 5000;

(b) from about 2 to 40 wt.% of an overbased detergent material;

(c) at least one of a zinc dihydrocarbyl dithiophosphate antiwear material, and a copper carboxylate antioxidant material, said antiwear material, when present, being employed in a concentration of from about 2 to 40 wt.%, and said copper carboxylate material, when present, being employed in a concentration of from about 0.5 to 25 wt.%; and (d) a compatibilizing effective amount of an adduct of the formula:

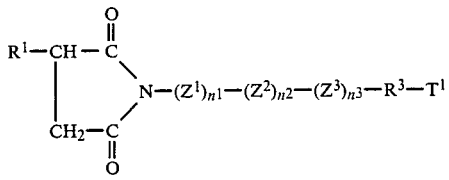

wherein $Z^1$ and $Z^3$ are the same or different and are moities of the formula:

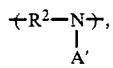

$Z^2$ is a moiety of the formula:

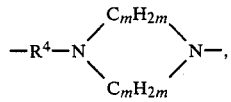

wherein $R^2$, $R^3$ and $R^4$ are the same or different and are alkylene of from 1 to 6 carbon atoms, m is an integer of from 1 to 5, each A' is independently selected from the group consisting of H, A and the moiety:

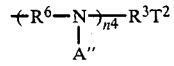

wherein A'' is H or A, $R^3$ is as defined above, $R^6$ is alkylene of from 1 to 6 carbon atoms, $T^1$ and $T^2$ are the same or different and each comprises a member selected from the group consisting of moieties of the formula:

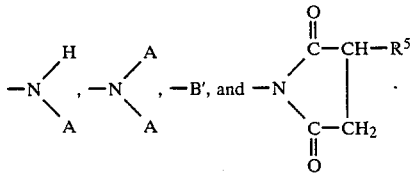

wherein B'is substituted or unsubstituted alkyl or aryl-containing group, $n^1$ is an integer of 0 to 10, $n^2$ is an integer of 0 to 10, $n^3$ is an integer of from 0 to 10, $n^4$ is an integer of from 0 to 10, with the provisos that the sum of $n^1$, $n^2$, $n^3$ and $n^4$ is from 3 to 10 and the sum of $n^1$, $n^3$ and $n^4$ is at least 1, wherein $R^1$ and $R^5$ are independently an olefin polymer having a number average molecular weight ($\overline{M}_n$) between about 650 and 3,500, and wherein A comprises:

(i) a substituted acetyl moiety of the formula:

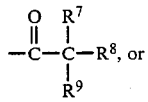

(ii) a tautomeric substituent of the formula:

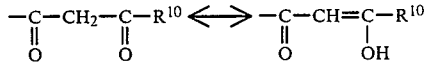

wherein $R^7$, $R^8$ and $R^9$ are the same or different and are H or alkyl of from 1 to 4 carbon atoms, and wherein $R^{10}$ is substituted or unsubstituted alkyl or aryl containing groups, with the proviso that at least one of the A' or A'' groups comprises said substituted acetyl or said tautomeric substituent.

2. The composition of claim 1 wherein $R^1$ and $R^5$ are each polyisobutylene.

3. The composition of claim 2 wherein the polyisobutylene has a $\overline{M}_n$ between about 1200 and about 3500.

4. The composition of claim 3 wherein the polyisobutylene has a $\overline{M}_n$ between about 1500 and about 3000.

5. The composition of claim 2 wherein $R^2$, $R^4$ and $R^6$ are each alkylene of from 2 to 4 carbon atoms.

6. The composition of claim 5 wherein $R^2$, $R^4$ and $R^6$ are each $—CH_2CH_2—$.

7. The composition of claim 6 wherein $n^2$ is zero and the sum of $n^1$, $n^3$ and $n^4$ is from 3 to 7.

8. The composition of claim 7 wherein $R^7$, $R^8$ and $R^9$ are each methyl.

9. The composition of claim 6 wherein $R^{10}$ is a methyl group.

10. The composition of claim 2 wherein $n^2$ is zero and the sum of $n^1$, $n^3$ and $n^4$ is from 3 to 7.

11. The composition of claim 2 wherein $R^{10}$ is a methyl group.

12. The composition of claim 2 wherein $R^7$, $R^8$ and $R^9$ are each methyl.

13. The composition of claim 2 wherein said composition further comprises a major amount of lubricating oil.

14. The composition of claim 1 wherein $R^{10}$ is a methyl group.

15. The composition of claim 1 wherein A is a trialkyl acetyl group.

16. The composition of claim 15 wherein $R^7$, $R^8$ and $R^9$ are each methyl.

17. The composition of claim 1 wherein the detergent material is an overbased alkaline earth metal sulfonate, an overbased alkaline earth metal phenate or a mixture thereof.

18. The composition of claim 17 wherein the alkaline earth metal is calcium.

19. The composition of claim 17 wherein the alkaline earth metal is magnesium.

20. The composition of claim 1 wherein said composition additionally comprises a major amount of lubricating oil.

21. The composition of claim 1 also containing a friction modifier material.

22. An oleaginous composition comprising:

(a) from about 1 to 70 wt.% of an ashless nitrogen or ester containing dispersant compound selected from the group consisting of:

(i) oil soluble salts, amides, imides, oxazolines and esters, or mixtures thereof, of long chain hydrocarbon substituted mono- and dicarboxylic acids or their anhydrides;

(ii) long chain aliphatic hydrocarbon having a polyamine attached directly thereto; and (iii) Mannich condensation products formed by condensing about a molar proportion of long chain hydrocarbon substituted phenol with about 1 to 2.5 moles of formaldehyde and about 0.5 to 2 moles of polyalkylene polyamine, wherein said long chain hydrocarbon group in (i), (ii), or (iii) is a polymer of a $C_2$ to $C_5$ monoolefin, said polymer having a molecular weight of about 700 to about 5000;

(b) from about 2 to 40 wt.% of an overbased detergent material;

(c) a copper carboxylate antioxidant material, said copper carboxylate material being employed in a concentration of from about 0.5 to 25 wt.%; and (d) a zinc dihydrocarbyl dithiophosphate antiwear material, said antiwear material being employed in a concentration of from about 2 to 40 wt.%; and (e) a compatibilizing effective amount of an adduct of the formula:

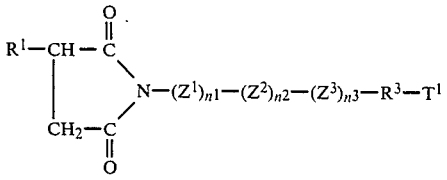

wherein $Z^1$ and $Z^3$ are the same or different and are moities of the formula:

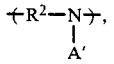

$Z^2$ is a moiety of the formula:

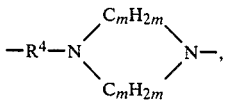

wherein $R^2$, $R^3$ and $R^4$ are the same or different and are alkylene of from 1 to 6 carbon atoms, m is an integer of from 1 to 5, each A' is independently selected from the group consisting of H, A and the moiety:

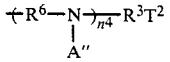

wherein A'' is H or A, $R^3$ is as defined above, $R^6$ is alkylene of from 1 to 6 carbon atoms, $T^1$ and $T^2$ are the same or different and each comprises a member selected from the group consisting of moieties of the formula:

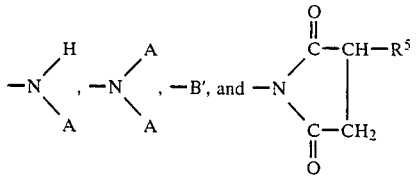

wherein B' is substituted or unsubstituted alkyl or aryl-containing group, $n^1$ is an integer of 0 to 10, $n^2$ is an integer of 0 to 10, $n^3$ is an integer of from 0 to 10, $n^4$ is an integer of from 0 to 10, with the provisos that the sum of $n^1$, $n^2$, $n^3$ and $n^4$ is from 3 to 10 and the sum of $n^1$, $n^3$ and $n^4$ is at least 1, wherein $R^1$ and $R^5$ are independently an olefin polymer having a number average molecular weight ($\overline{M}_n$) between about 650 and 3,500, and wherein A comprises:

(i) a substituted acetyl moiety of the formula:

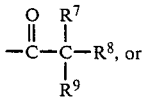

(ii) a tautomeric substituent of the formula:

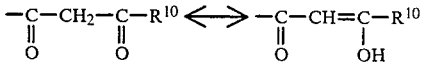

wherein $R^7$, $R^8$ and $R^9$ are the same or different and are H or alkyl of from 1 to 4 carbon atoms, and wherein $R^{10}$ is substituted or unsubstituted alkyl or aryl containing groups, with the proviso that at least one of the A' or A'' groups comprises said substituted acetyl or said tautomeric substituent.

23. The composition of claim 22 wherein $R^1$ and $R^5$ are polyisobutylene.

24. The composition of claim 23 wherein the polyisobutylene has $\overline{M}_n$ between about 1200 and about 3500.

25. The composition of claim 24 wherein the polyisobutylene has $\overline{M}_n$ between about 1500 and about 3000.

26. The composition of claim 25 wherein $n^2$ is zero and the sum of $n^1$, $n^3$ and $n^4$ is from 3 to 7.

27. The composition of claim 26 wherein $R^{10}$ is a methyl group.

28. The composition of claim 24 wherein $n^2$ is zero and the sum of $n^1$, $n^3$ and $n^4$ is from 3 to 7.

29. The composition of claim 23 wherein $R^3$, $R^4$ and $R^6$ are each alkylene of from 2 to 4 carbon atoms.

30. The composition of claim 29 wherein $R^2$, $R^4$ and $R^6$ are each $-CH_2CH_2-$.

31. The composition of claim 30 wherein $R^{10}$ is a methyl group.

32. The composition of claim 23 wherein $R^{10}$ is a methyl group.

33. The composition of claim 23 wherein said composition further comprises a major amount of lubricating oil.

34. The composition of claim 22 wherein $R^{10}$ is a methyl group.

35. The composition of claim 22 wherein the copper carboxylate is copper oleate.

36. The composition of claim 22 wherein the copper carboxylate is copper naphthenate.

37. The composition of claim 22 wherein the copper carboxylate is the copper salt of a $C_{10}$–$C_{18}$ fatty acid.

38. The composition of claim 22 wherein the detergent material is an overbased alkaline earth metal sulfonate, an overbased alkaline earth metal phenate or a mixture thereof.

39. The composition of claim 22 wherein the alkaline earth metal is calcium.

40. The composition of claim 22 wherein the alkaline earth metal is magnesium.

41. The composition of claim 22 wherein said composition further comprises a major amount of lubricating oil.

42. The composition of claim 22 also containing a friction modifier material.

43. An oleaginous composition comprising:

(a) at least one of an overbased detergent material, wherein said detergent material, when present, is employed in an amount of from about 2 to 40wt. %; a copper carboxylate antioxidant material, wherein said antioxidant material, when present, is employed in a concentration of from about 0.5 to 25 wt.%; a zinc dihydrocarbyl dithiophosphate antiwear material, wherein said antiwear material, when present, is employed in a concentration of from about 0.5 to 25 wt.%; and (b) a compatibilizing effective amount of an adduct of the formula:

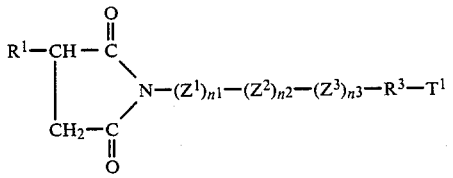

wherein $Z^1$ and $Z^3$ are the same or different and are moities of the formula:

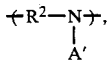

$Z^2$ is a moiety of the formula:

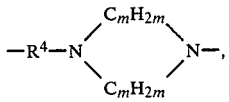

wherein $R^3$, $R^3$ and $R^4$ are the same or different and are alkylene of from 1 to 6 carbon atoms, m is an integer of from 1 to 5, each A′ is independently selected from the group consisting of H, A and the moiety:

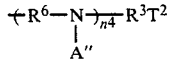

wherein A″ is H or A, $R^3$ is as defined above, $R^6$ is alkylene of from 1 to 6 carbon atoms, $T^1$ and $T^2$ are the same or different and each comprises a member selected from the group consisting of moieties of the formula:

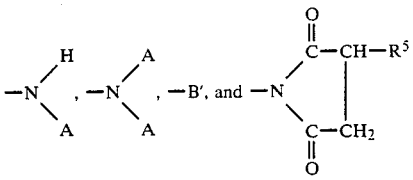

wherein B′ is substituted or unsubstituted alkyl or aryl-containing group, $n^1$ is an integer of 0 to 10, $n^2$ is an integer of 0 to 10, $n^3$ is an integer of from 0 to 10, $n^4$ *is an integer of from* 0 to 10, with the provisos that the sum of $n^1$, $n^2$, $n^3$ and $n^4$ is from 3 to 10 and the sum of $n^1$, $n^3$ and $n^4$ is at least 1, wherein $R^1$ and $R^5$ are independently an olefin polymer having a number average molecular weight ($\overline{M}_n$) between about 650 and 3,500, and wherein A comprises:

(i) a substituted acetyl moiety of the formula:

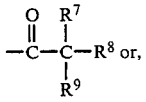

(ii) a tautomeric substituent of the formula:

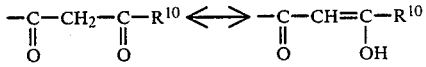

wherein $R^7$, $R^8$ and $R^9$ are the same or different and are H or alkyl of from 1 to 4 carbon atoms, and wherein $R^{10}$ is substituted or unsubstituted alkyl or aryl containing groups, with the proviso that at least one of the A′ or A″ groups comprises said substituted acetyl or said tautomeric substituent.

44. The composition of claim 43 wherein $R^2$, $R^4$ are $R^6$ are alkylene of from 2 to 4 carbon atoms.

45. The composition of claim 44 wherein $R^2$, $R^4$ and $R^6$ are each $—CH_2CH_2—$.

46. The composition of claim 45 wherein $n^2$ is zero and the sum of $n^1$, $n^3$ and $n^4$ is from 3 to 7.

47. The composition of claim 46 wherein $R^{10}$ is a methyl group.

48. The composition of claim 43 wherein $R^{10}$ is a methyl group.

49. The composition of claim 45 wherein said composition further comprises a major amount of lubricating oil.

50. The composition of claim 44 wherein $R^{10}$ is a methyl group.

51. The composition of claim 43 wherein $R^{10}$ is a methyl group.

52. The composition of claim 43 wherein A is a trialkyl acetyl group.

53. The composition of claim 52 wherein $R^7$, $R^8$, and $R^9$ are methyl groups.

54. The composition of claim 43 wherein the detergent material is an overbased alkaline earth metal sulfonate, an alkaline earth metal phenate or a mixture thereof.

55. The composition of claim 54 wherein the alkaline earth metal is calcium.

56. The composition of claim 54 wherein the alkaline earth metal is magnesium.

57. The composition of claim 43 wherein said composition further comprises a major amount of lubricating oil.

58. The composition of claim 43 also containing a friction modifier material.

59. The composition of claim 43 wherein the copper carboxylate is copper oleate.

60. The composition of claim 43 wherein the copper carboxylate is copper naphthenate.

61. The composition of claim 43 wherein the copper carboxylate is the copper salt of a $C_{10}$–$C_{18}$ fatty acid.

* * * * *